US005301935A

United States Patent [19]

Miki et al.

[11] Patent Number: 5,301,935

[45] Date of Patent: Apr. 12, 1994

[54] APPARATUS FOR INSERTING AND SEALING ENVELOPES WITH TEMPORARY STORAGE POCKET

[75] Inventors: Toshio Miki; Masato Takeda; Yoshiyuki Ishikura, all of Komae, Japan

[73] Assignee: Duplo Corporation, Tokyo, Japan

[21] Appl. No.: 913,370

[22] Filed: Jul. 15, 1992

[30] Foreign Application Priority Data

Jul. 15, 1991 [JP] Japan ..... 3-201249
Jul. 15, 1991 [JP] Japan ..... 3-201250

[51] Int. Cl.[5] ..... B42C 1/00; B65B 1/00

[52] U.S. Cl. ..... 270/45; 270/54; 53/284.3; 53/569

[58] Field of Search ..... 270/32, 54, 58, 45, 270/51; 53/50, 284.3, 569

[56] References Cited

U.S. PATENT DOCUMENTS 3,797,196 3/1974 Harbison ..... 53/569 X
4,020,615 5/1977 Irvine et al. ..... 53/284.3 X
4,169,341 10/1979 Roetter et al. ..... 53/569 X
4,932,188 6/1990 Krasuski et al. ..... 53/284.3 X
4,944,137 7/1990 Krasuski et al. ..... 53/569
4,970,654 11/1990 Francisco ..... 270/58 X
5,000,434 3/1991 VanderSvde et al. ..... 270/54
5,029,832 7/1991 Orsinger et al. ..... 270/54

*Primary Examiner*—Edward K. Look
*Assistant Examiner*—John Ryznic
*Attorney, Agent, or Firm*—Oblon, Spivak, McClelland, Maier & Neustadt

[57] ABSTRACT

The envelope is always moved in a direction perpendicular to the fold of the flap thereof. In the course of the moving path the moving direction of the envelope is turned over by means of reverse roller 15, the flap is folded and the opening of the envelope is expanded while the envelope is being halted at the content-inserting portion. In this state the content such as a letter etc. is inserted from the expanded opening of the envelope. Then after the gummed flap is damped, the flap is folded and sealed. Thus, the movement of the envelope can be simplified and the enclosing and sealing apparatus can be reduced in size.

4 Claims, 8 Drawing Sheets

APPARATUS FOR INSERTING AND SEALING ENVELOPES WITH TEMPORARY STORAGE POCKET

BACKGROUND OF THE INVENTION

The present invention relates to an enclosing and sealing apparatus for enclosing a content, such as a letter being triple-folded, into a western type envelope, and more particularly relates to an enclosing and sealing apparatus which is reduced in size and is suitable for desk-top use in offices, and wherein a western type envelope of, for example, 10 inches width, is enclosed with a letter and thereafter sealed by wetting the gummed portion on the flap with water and adhering the flap thereon.

In a conventional envelope enclosing and sealing apparatus, an envelope is conveyed in a carriage path which is parallel to the fold of the flap thereof, and on that way, is pasted on its flap and then moved off said carriage path into a direction perpendicular thereto by means of a roller having a rotary shaft in parallel with the fold of the flap. In this step, the flap is folded outside in and applied to seal the opening portion. (For example, Japanese Patent Publication No. 21840/1986.)

In thus constructed conventional envelope enclosing and sealing apparatus, an envelope is conveyed in a direction parallel to the fold of the flap thereof, then pasted and thereafter moved off in a direction perpendicular to the fold of the flap of the envelope, so that the conveyance of the envelope requires a large area in a plane of projection. For this reason, the conventional apparatus has a drawback that the apparatus becomes large.

SUMMARY OF THE INVENTION

It is an object of the present invention to provide an enclosing and sealing apparatus which is reduced in size by simplifying the conveyance of the envelope.

An enclosing and sealing apparatus according to the present invention comprises: a hopper portion in which a plurality of envelopes are held; a content-inserting portion in which a content is inserted into said envelope; a guide means for guiding said envelope moving from said hopper portion to said content-inserting portion along an envelope-moving path; a reverse roller disposed in said envelope-moving path for turning over said envelope-moving path; a flap unfolding member disposed in the course of said moving path for unfolding the flap of said envelope when said envelope passes therethrough; an expanding means for advancing into the inside from the opening of said envelope staying at said content-inserting portion and expanding said opening; a paper-folding means for folding a content and inserting said folded content into said envelope with its opening being spread out by said expanding member; and a sealing means for damping the gummed portion on the flap of said envelope and closing said flap.

The enclosing and sealing apparatus may have a stacking means for collecting sealed envelopes sent from said sealing means with keeping their folds of flaps substantially horizontally. Said stacking means comprises a holding member for holding envelopes upright, a supporting member for supporting upright envelopes with its wall, a pressing member for holding said envelopes together with said supporting member, a biasing means for biasing said pressing member toward said supporting member, wherein said supporting member and pressing member are respectively shaped forming a bent at their center viewed from top, and said envelopes are collected with their folds of flaps being bent.

According to the present invention, an envelope is always moved in a direction perpendicular to the fold of its flap thereof. While the envelope is moved by means of the guide means, its flap being unfolded by the flap-unfolding member, the envelope reaches and halts at, the content-inserting position disposed in the guide means. For the halting envelope the expanding member spreads out the opening of the envelope, from which a content folded by the paper-folding means is inserted into the envelope. Then the envelope is wetted at its flap by means of the sealing means, thereby to be sealed. Thus, the envelope is always moved in a direction perpendicular to the fold of the flap, so that the conveyer mechanism can be simplified and reduced in the moving range of the envelope.

In addition, the moving path of an envelope is turned over using a reverse roller, whereby the moving path is fabricated spatially, and consequently, the moving path can be reduced to half the length that is required for the planar movement.

Thus, one way movement and spatial structure permit the enclosing and sealing apparatus of the present invention to be reduced in size.

As stated above, according to the present invention, since an empty envelope is moved in a direction perpendicular to the fold of the flap thereof, the conveyer mechanism can be simplified while the moving path of an envelope can be shortened. In addition, since the moving path of an envelope is turned over by means of the reverse roller, the moving path can be structured in a three-dimensional form, thus making it possible to reduce the projected area on plane. Accordingly, the whole configuration of the apparatus can be reduced in size utilizing space effectively.

Moreover, since a content is inserted into an envelope with its opening being opened up by the expanding member while the envelope is halted at the content-inserting position, it is possible to spread out the opening surely, and thus a content such as letter or the like can be easily inserted.

DETAILED DESCRIPTION OF THE PREFERRED EMBODIMENTS

Now referring to the accompanying drawings, an embodiment of the present invention will be described specifically.

Figure 1:
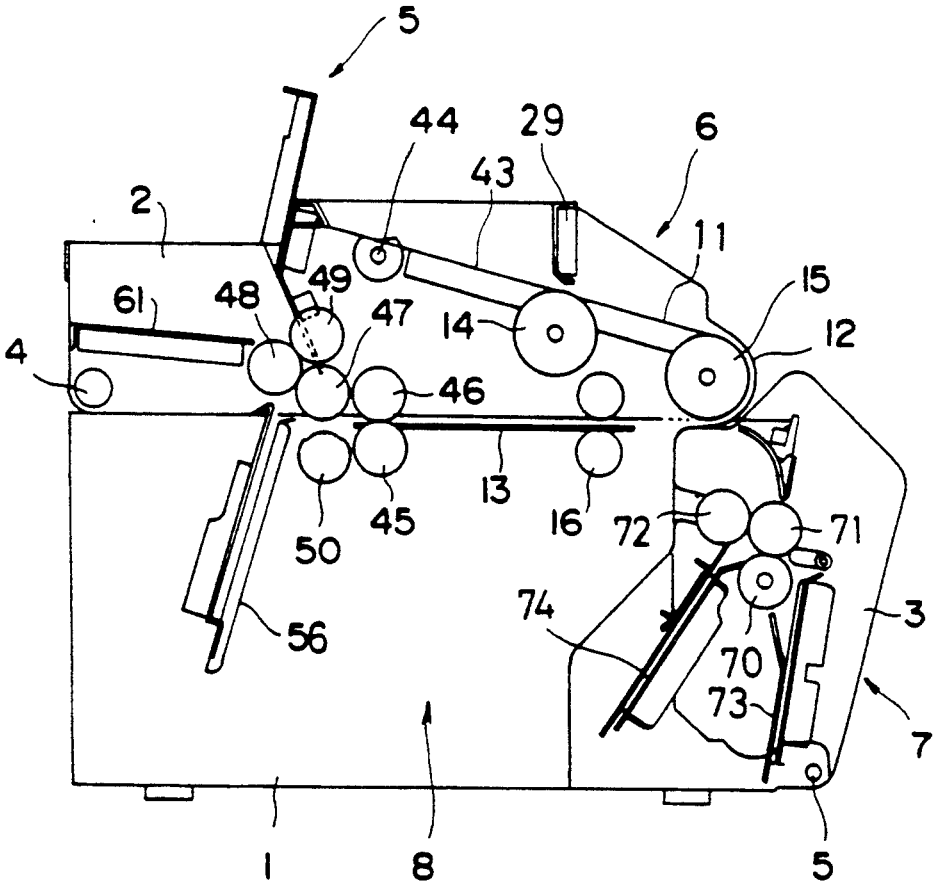
FIG. 1 is a schematic elevation showing an inside of an enclosing and sealing apparatus according to an embodiment of the present invention.
Figure 2:
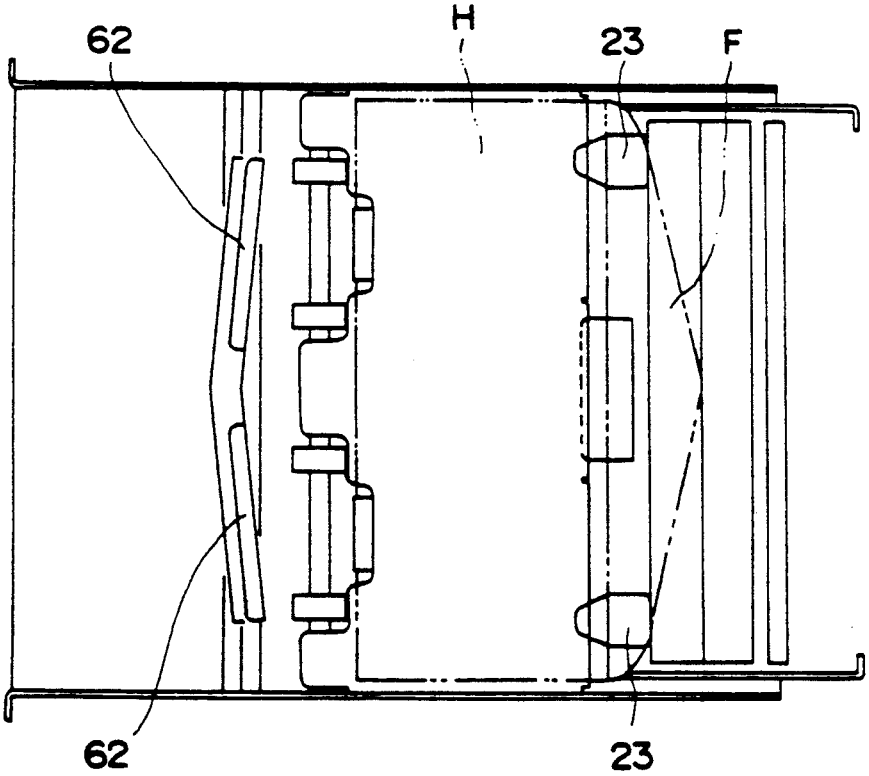
FIG. 2 is a schematic plan view of the same apparatus shown in FIG. 1.

As shown in FIG. 1, the sealing apparatus of this embodiment is composed of three parts, which are respectively stored in cases 1, 2 and 3. Case 1 holds driving portion 8; case 2 holds stacking portion 5 in which sealed envelopes are collected and envelope feeding portion 6 from which empty envelopes are fed; and case 3 holds folding portion 7 which folds a content such as letter in three. Case 1 is, for example, fixed on a desk, and case 2 is attached to case 1 and is rotatable relative to case 1 around shaft 4. When an envelope jam occurs, this case 2 is rotated and opened upward, or in other word stacking portion 5 and feeding portion 6 are together lifted up to open the inside, whereby the jammed envelope can be removed. In the same manner, folding portion 7 can be released by rotating case 3, thus allowing removal of a letter jammed inside.

In envelope feeding portion 6 which feeds envelope H are disposed hopper 43 for holding empty envelopes H and faceted roller 44 for sending out envelope H. Envelopes H are set on hopper 43 with their flaps upward and being positioned upstream when they are conveyed. Hopper 43 is inclined slightly so that the envelopes stacked are inclined downward and is caught by split plate 29 at its front end. Between hopper 43 and the lower end of this split plate 29 is formed an aperture through which an envelope can pass. An envelope H stacked on hopper 43 is pushed out by faceted roller 44, being split by split plate 29 and fed out sequentially from the bottom.

Under split plate 29 is disposed feed roller 14. There is disposed reverse roller 15 in a position downstream slightly below feed roller 14. Between feed roller 14 and reverse roller 15 is disposed guide plate 11 for guiding envelopes. Reverse roller 15 guides envelopes using its half-peripheral surface together with reverse guide plate 12 having a shape of half cylinder disposed facing to reverse roller 15. An envelope H is pressed between reverse roller 15 and reverse guide plate 12, and driven by frictional force along the half peripheral surface of reverse roller 15. Under reverse roller 15 is disposed guide plate 13 extending horizontally, to which in turn is guided the envelope having passed along the peripheral surface of reverse roller 15 and reverse guide plate 12. Between horizontal guide plate 13 and reverse roller 15 guide is disposed conveyer roller 16 which pushes forward the envelope coming from reverse roller 15 along guide plate 13. The envelope guiding path is constructed with these guide plates 11, 12 and 13, and envelopes are turned over in its advancing direction by means of reverse roller 15 disposed in the course of the guiding path.

There are disposed stopper 18 and sensor 17 at the starting point of this guiding path, or near feed roller 14. Stopper 18 is driven by means of plunger 19, and normally is being biased upward by a proper spring. Accordingly, while plunger 19 is being unactuated, the tip of the stopper 18 is selectively protruded out above guide plate 11 by biasing force of the spring. On the other hand, when the plunger 19 is activated, the tip of the stopper 18 is made to retract below guide plate 11. Sensor 17 is to detect the rear end of an envelope moving on guide plate 11. When this sensor 17 detects the rear end of the envelope, the plunger 19 gets unactuated, this allows stopper 18 to protrude out above guide plate 11 so as to keep the next envelop from coming out by hooking its front end.

Around reverse roller 15 there is disposed a nail member 22 for unfolding the flap of envelopes. Body 20 of this nail member 20 is able to be rotated around supporting shaft 21, and is formed with nail member 22 at upstream end. The downstream end of body 20 is crooked like a hook, and when the forward end of the envelope reaches this hooked portion and presses it upward, the body 20 is rotated while nail member 22 being pressed downward. Thus downed nail member 22 hooks flap F extended from the rear end of envelope H moving, to raise up flap F on the rear edge of envelope H as a fulcrum, and further flap F is turned over. With this, flap F of envelope H is unfolded and thus the opening of the envelope is freed.

Figure 5:
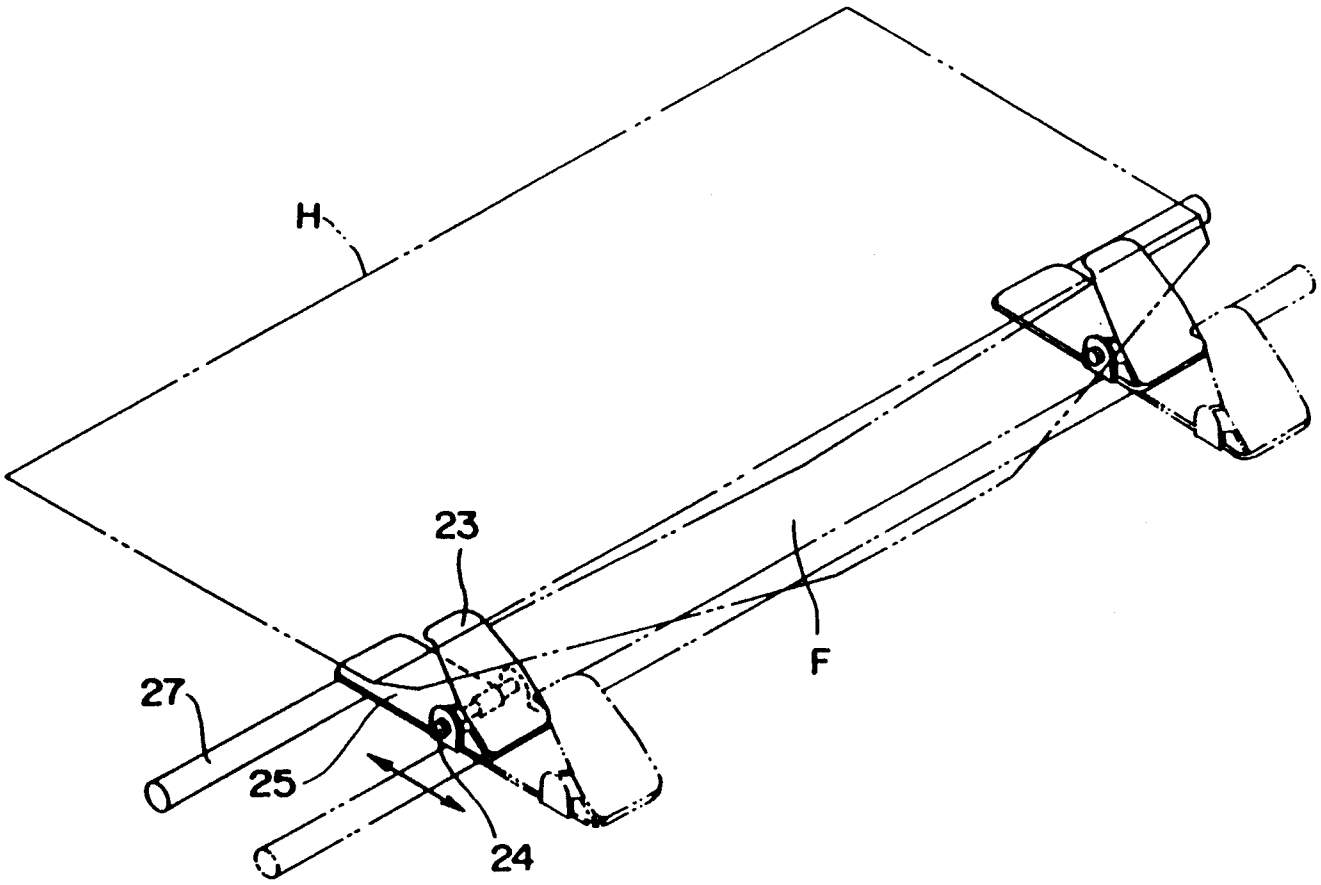
FIG. 5 is a perspective view showing nail members of the same apparatus shown in FIG. 1.
Figure 6:
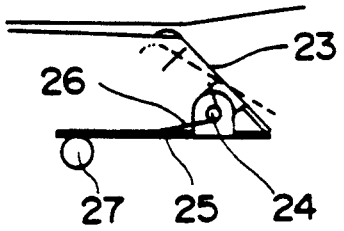
FIG. 6 is a schematic view for illustrating the operation of the nail member of FIG. 5.

A pair of nail members 23 for spreading out the opening of an envelope are disposed between reverse roller 15 and conveyer roller 16. FIG. 5 shows a perspective view showing these nail members 23 in a large scale, and FIG. 6 is a schematic view showing operation of nail member 23. There are provided a pair of nail members 23 keeping a certain interval from one another in parallel with the fold of flap F of envelope H. Specifically, in the width direction of envelope H or in parallel with the fold of flap F there is provided supporting rod 27, to which a pair of base members 25 are fixed with their attitudes being leveled, keeping a certain interval between the pairs smaller than the width of envelope H. As shown in FIG. 5, each nail members 23 is supported by corresponding base member 25 and rotatable around axis 24, while being pressed by the base member 25 with a proper spring so as to be able to be opened at its end. Supporting rod 27 is moved from side to side horizontally by means of link cam mechanism, which will be described hereinafter. With this mechanism, nail members 23 hook the lower part of envelope H which is not provided with a flap F (i.e., as shown in FIG. 6, the nail members 23 hook the portion of the envelope opening opposite to the flap side) and open it downward.

At the end of the conveying path of an envelope, stopper 30 is disposed. This stopper 30 is attached on shaft 33 and is able to be rotated around shaft 33. Link 31 is fixed to this stopper 30 forming a predetermined angle with the arm portion of stopper 30 while being able to be rotated around shaft 33. In addition, other end of this link 31 has roller 32 attached thereto.

In driving portion 8, a large gear 35 is disposed with its rotation shaft in parallel with rotation shafts of roller 14, reverse roller 15 and conveyer roller 16. Switching actuator 37 is fixed coaxially on this large gear 35. Near this large gear 35 there is provided a switch 36 which is activated when actuator 37 rotates and comes to the disposed position of switch 36. By this, large gear 35 is detected to make one revolution.

Figure 3:
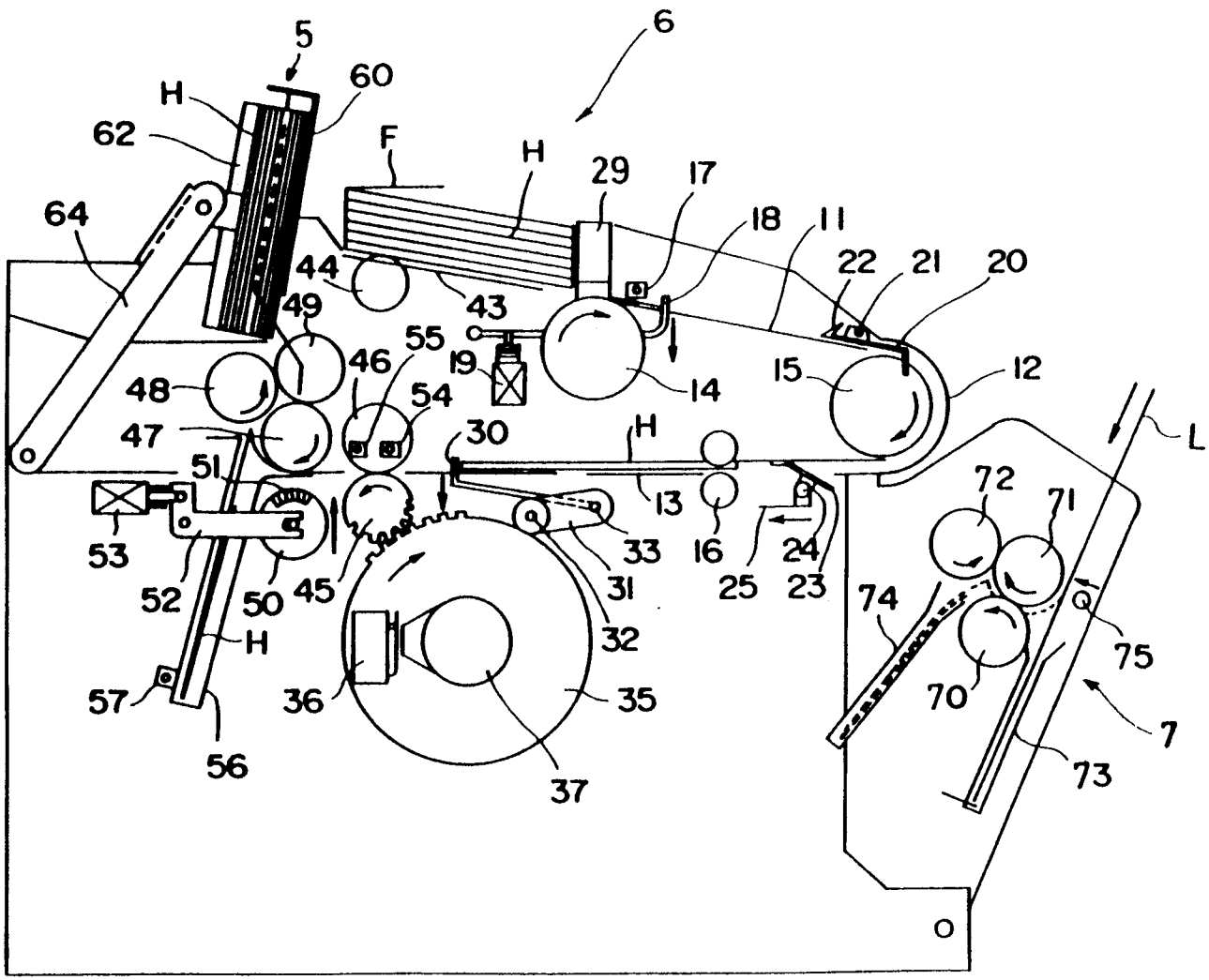
FIG. 3 is a schematic elevation showing the sealing portion of the same apparatus shown in FIG. 1.
Figure 4:
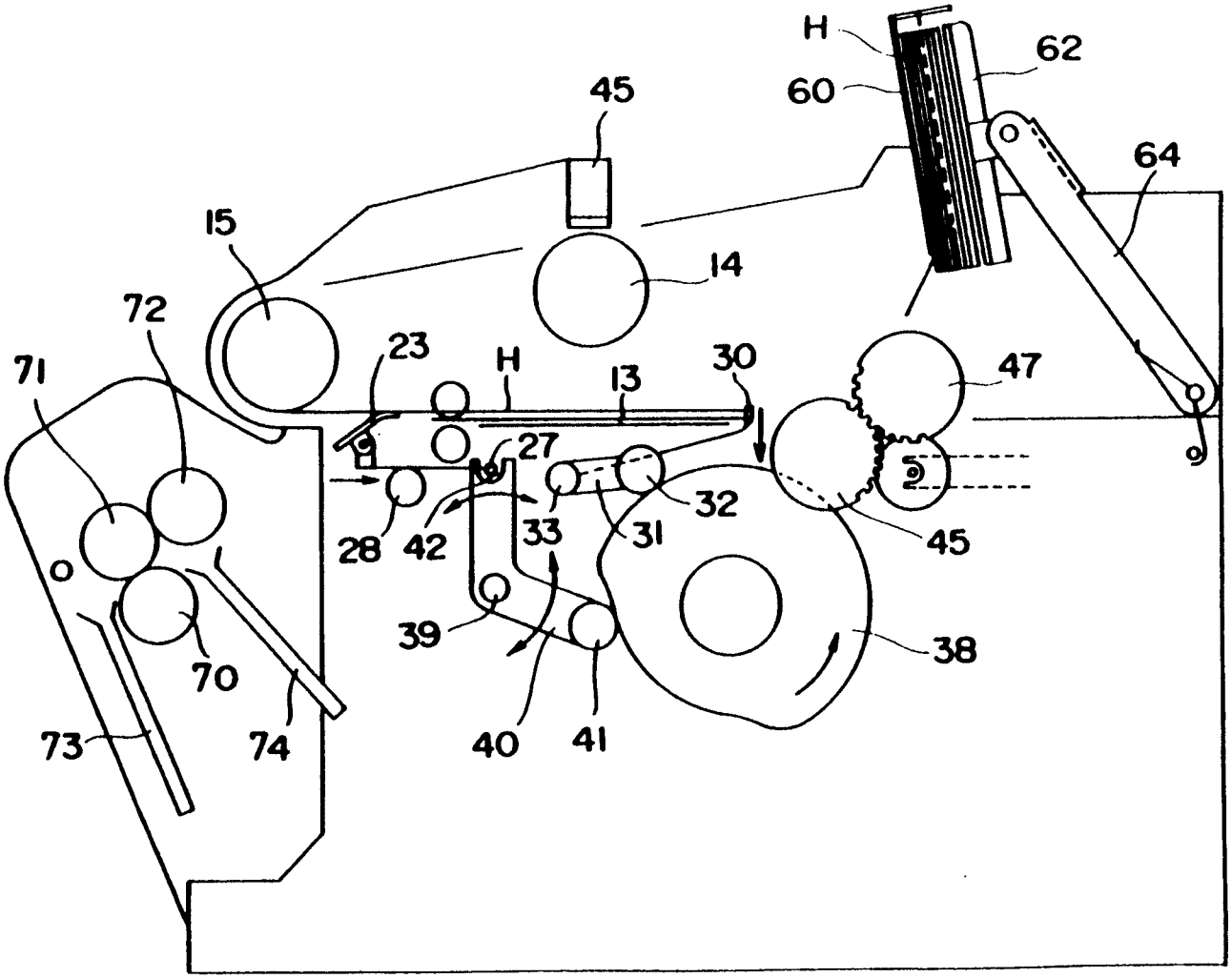
FIG. 4 is a schematic rear elevation showing the same portion shown in FIG. 3.

Cam 38, as shown in FIG. 4, is attached coaxially with the rotation axis of large gear 35 shown in FIG. 3. With this arrangement, cam 38 rotates at the same angular velocity with large gear 35. This cam 38 has an irregular peripheral surface, on which roller 32 rolls. In this arrangement, roller 32 oscillates around axis 33, whereby moving stopper 30 up and down. In addition, V-shaped arm 40 is attached on its center part at axis 39. V-shaped arm 40 is able to be rotated around axis 39. One end of this arm 40 has a pit 42 formed, into which supporting rod 27 linked with nail member 23 for expanding opening of envelope is fit. Meanwhile, the other end of arm 40 is provided with roller 41, which rolls on peripheral surface of cam 38. With this, if cam 38 rotates, arm 40 oscillates on axis 39, whereby supporting rod 27 moves horizontally from side to side.

As shown in FIG. 3, at the end of the moving path of envelope H, a pair of conveyer rollers 45 and 46 with horizontal rotation axes are disposed vertically facing to each other around stopper 30. The lower roller 45 is provided with a coaxial gear which is engaged with large gear 35 as shown schematically in FIG. 3, and driven by large gear 35 through this gear. Here the upper roller 46 works as a follower roller.

In front of conveyer rollers 45 and 46 there are disposed envelope advancing-direction changeover pocket 56. The entrance of this pocket 56 is located just in front of the envelope which is sent out by conveyer rollers 45 and 46, and is inclined slightly with respect to vertical direction. Envelope H which is sent out by conveyer rollers 45 and 46 enters pocket 56 from its front end. Thus inserted envelope H is detected by sensor 57 which is disposed at the bottom of pocket 56. Damping member 50 is disposed on the lower side of moving range of envelope H between pocket 56 and conveyer rollers 45 and 46. This damping member 50 is made to be moved up and down through arm 52 by plunger 53. There is provided water holder 51 which contains and keeps water on a part of the peripheral surface of damping member 50. In this arrangement, when damping member 50 is moved upward by means of plunger 53, water holder 51 of damping member 50 is brought into contact with the gummed portion of flap F located at the rear portion of envelope H sent out from conveyer rollers 45 and 46, and thereby wets the gummed portion.

Water holder 51 is made on one segment of damping member 50 by applying and stretching a piece of fiber, to which water is supplied from the center of damping member 50, which in turn receives water from an external water tank (not shown) via a rubber tube.

Envelope H which has been wetted at its gummed portion of flap F by means of damping member 50, is inserted once into pocket 56 with its forward end down or its flap up. Acceptance of envelope H by pocket 56 is detected by sensor 57 as stated above.

Near roller 46 there are disposed a pair of sensors 54 and 55. Sensor 54, which is disposed upstream with respect to the envelope flow, is to detect the completion of passage of envelope H. Based on the detection of envelope H passing by, the clutch is connected or disconnected. On the other hand, sensor 55 detects the passage of envelope H, and then plunger 53 is unactuated during the passage of envelope H. With this, damping member 50 moves down so as to prevent water holder 51 from contacting and wetting envelope H. When the gummed portion on the flap comes to the position of damping member 50, the front end of the envelope reaches the position of sensor 57 disposed in pocket 56, and the sensor 57 detects the front end of the envelope. At the time sensor 57 detects the front end of the envelope, plunger 53 is activated to drive damping member 50 upward. With this, water holder 51 is brought into contact with the flap to wet its gummed portion. As stated above, sensors 55 and 57 controls damping portion 50 to move up only when the flap is passing.

Discharge roller 47 is, as shown in FIG. 4, provided with a coaxial gear. This gear is interlocked with the gear of conveyer roller 45. Thus, discharge roller 47 is driven through gear for discharge roller 47 and gear for conveyer roller 45 by large gear 38. The other discharge rollers, namely rollers 48 and 49 shown in FIG. 3 are follower rollers.

Envelope H once stored in pocket 56 with its flap F being unfolded, is moved upward while its flap being fold by the rotation of driving discharge roller 47 and follower discharge roller 48, and caught between these rollers 47 and 48. Thus moved envelope H with folded flap F is adhesively fixed by the pressure between rollers 47 and 48. Then the sealed envelope is lead between rollers 48 and 49, to thereby be collected on stacking portion 5.

Figure 7:
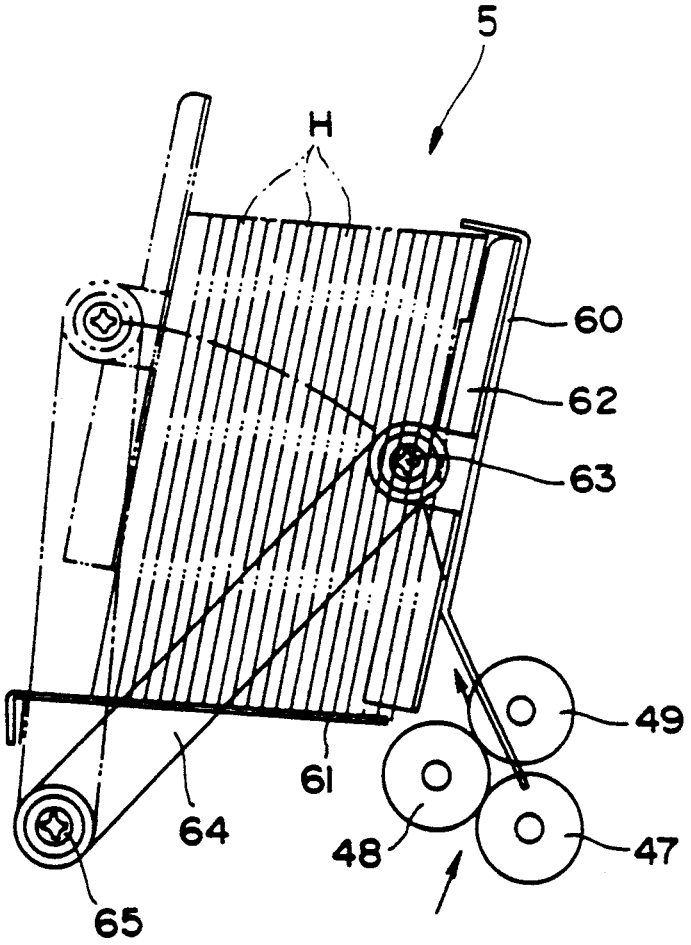
FIG. 7 is a schematic elevation showing an envelope stacking portion of the apparatus shown in FIG. 1.
Figure 8:
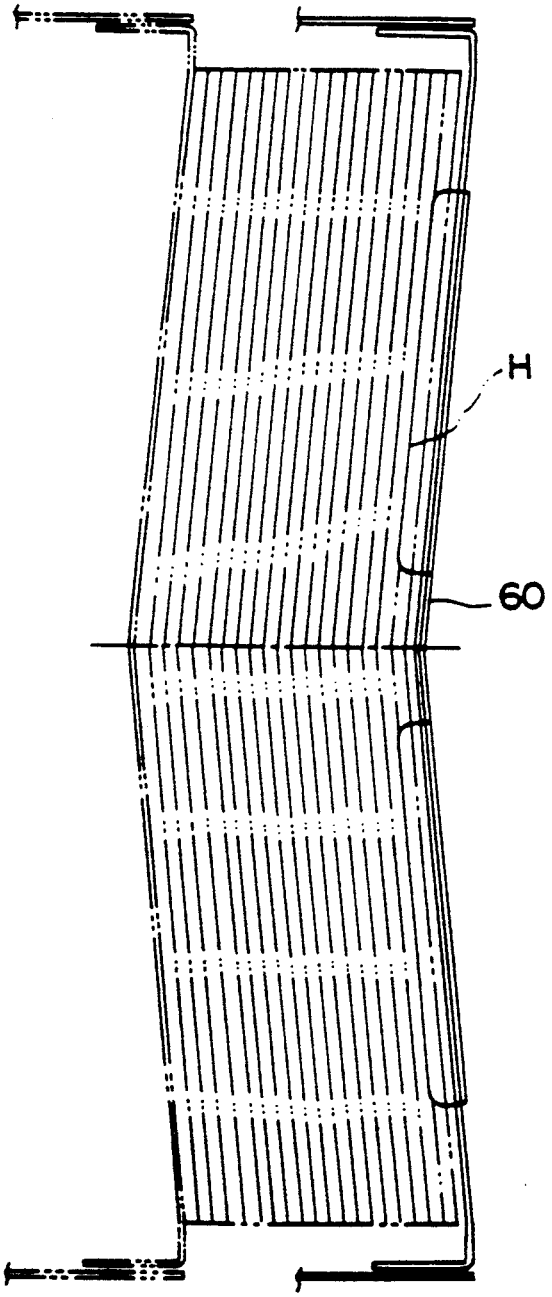
FIG. 8 is a plan view showing the same envelope stacking portion shown in FIG. 7; and, FIG. 9 shows a pressing plate and discharge plate which are bent at their respective centers.

This stacking portion 5 is provided over pocket 56, and as shown in FIG. 7, stack plate 61 of stacking portion 5 is disposed horizontally with its one end near a pair of discharge rollers 48 and 49. On the other hand, discharge plate 60 is disposed with its upper portion being inclined toward the envelope feeding portion 6. Between stack plate 61 and discharge plate 60 there is disposed an aperture, through which envelope H is introduced onto stack plate 61. Under the other end of stack plate 61 there is provided supporting shaft 65, which supports arm 64 at its one end in a rotatable condition. The other end of arm 64 holds flat pressing plate 62. This arm 64 is pressed against discharge plate 60 with proper pressing force. With this mechanism, envelopes H which have been introduced onto stack plate 61 are pressed toward discharge plate 60 by pressing plate 62, and consequently are stacked on stack plate 61 with being approximately upright. Meanwhile, as apparent from the plan view in FIG. 8, discharge plate 60 is bent at its center on the horizontal cross-sectional plane, with its bending portion protruding toward the direction in which enveloped are introduced.

With respect to paper folding portion 3, as shown in FIGS. 1 and 3, three folding rollers 70, 71 and 72 are disposed with their shaft being kept horizontally under reverse roller 15. Under roller 70 there is disposed first folding member 73 with its upper end extending toward the position between roller 70 and roller 71. Second folding member 74 is disposed with its upper end extending toward the arrangement center of rollers 70, 71 and 72. Each of folding members 73 and 74 is to be inserted with a content such as a letter and holds it at its bottom. A letter is manually inserted into first folding member 73. This first folding member 73 has at its bottom a switch (not shown) which is operated when the front end (lower end) of a sheet to be folded such as a letter etc. is brought into contact with the switch. When a letter is detected as to be inserted into folding member 73 by means of the switch, the detection signal trigger the rotation of large gear 35. Near roller 71 there is pressing member 75 made of a roll having a small diameter. This pressing member 75 can take two positions. In one position, the pressing member 75 rolls on roller 71, whereas in another position it is located away form the roller 71.

Next will be described operation of the thus constructed apparatus of this embodiment. At the beginning, as shown in FIG. 3, empty envelopes H are piled up on hopper 43. When a stand-by switch (not shown) is turned to ON, delivery roller 44 delivers the bottom envelop H on hopper 43 to feed roller 14, while plunger 19 is activated to let stopper 18 down. With this, envelope H passes by stopper 18, and moved on guide plate 11 by feed roller 14 toward reverse roller 15. When sensor 17 detects the rear end of envelope H, plunger 19 is made to become inactivated, thereby moving up stopper 18. Consequently the stopper 18 stops the next envelope from passing.

Envelope H moving on guide plate 11 contacts at its front end with crooked portion of body 20 for unfolding flap and raises it up to pass. Subsequently, the front end of the envelope H is held between reverse roller 15 and guide plate 12, being driven by reverse roller 15 toward guide plate 13. When the rear half-portion of envelope H passes by the position of nail member 22, flap F is raised and unfolded by nail member 22. With this, envelope H passes through reverse roller 15 with its flap F being opened.

Envelope H is turned over in its advancing direction by means of reverse roller 15, and then is driven on guide plate 13 by conveyer roller 16 toward the stand-by position (end point of the moving path), at which stopper 30 is disposed. Envelope H is caught at its front end by stopper 30 to be stopped. This completes the stand-by state for sealing. In this stand-by state, flap F is being held between roller 15 and guide plate 12.

Here, an operator manually inserts, for example, A4-sized letter L (sheet to be folded) into the first folding member 73 of paper-folding portion 7. The front end of the inserted letter L is put into contact with the switch disposed at the bottom of folding member 73, thus turning the switch on. Then, in accordance with the detection signal of this switch, large gear 35 starts to turn, and as shown in FIG. 4, roller 41 which rolls on the peripheral surface of cam 38, moves arm 40, thereby rolling supporting rod 27 from side to side. With this movement, a pair of nail members 23 for expanding the opening of the envelope, advance into the inside from the opening of envelope H staying at the stand-by position and spread out the opening.

With regard to paper-folding portion 7, as shown in FIG. 3, when an operator inserts letter L into folding member 73, pressing member 75 moves toward roller 71. The paper to be folded is held between thus moved pressing member 75 and roller 71, and a bend is made to occur by the rotation of roller 71. The portion at which the paper bends is caught between rollers 70 and 71, thus making a first fold. Subsequently, letter L proceeds into next folding member 74 with the first fold at the head, and this first fold is received and stopped at the bottom of folding member 74. Letter L is sent into folding member 74 while being driven and caught by rollers 70 and 71, so that another bend occurs near rollers 71 and 72. This bend is caught and drawn between rollers 71 and 72, to make another fold. Thus letter L is folded two times and sent by a proper guide to the position where nail member 23 is disposed.

This triple-folded letter L is inserted into envelope H which stands by with its opening being spread out by nail members 23. In this while, cam 38 continuously rotates, allowing roller 41 to roll thereon. With this, arm 40 is made to change its moving direction, to thereby withdraw nail members 23 from envelope H.

Roller 32 also rolls on cam 38, this makes stopper 30 down. Envelope H, to which triple-folded letter has been inserted, is sequentially released from stopper 30, to be driven forward by conveyer roller 16 and drawn between conveyer rollers 45 and 46. Thus drawn envelope H is sent into advancing direction changeover pocket 56. With operations of sensors 55 and 57, flap F located at the rear end of this envelope H is given water onto its gummed portion by means of water holder 51 on the way of passing over damping member 50. In this connection, note that a next envelope H is sent out from the hopper toward the stand-by position at the moment the envelope H in the stand-by position is send out.

The flap is drawn out from between feed rollers 45 and 46 after envelope H has been inserted once into pocket 56 till the front end of the envelope reaches the bottom of pocket 56, so that the flap is slowly folded back, and then the envelope is caught between discharge rollers 47 and 48 with the fold of the flap at its head. Thus, envelope H is driven upward by means of rollers 47 and 48. In passing through between rollers 47 and 48, flap F is laid down on the opening of envelope H, pressed between rollers 47 and 48, and thus flap F is adhered onto the opening of envelope H. In this manner, the sealing of an envelope with a triple-folded letter enclosed is completed.

Figure 9:
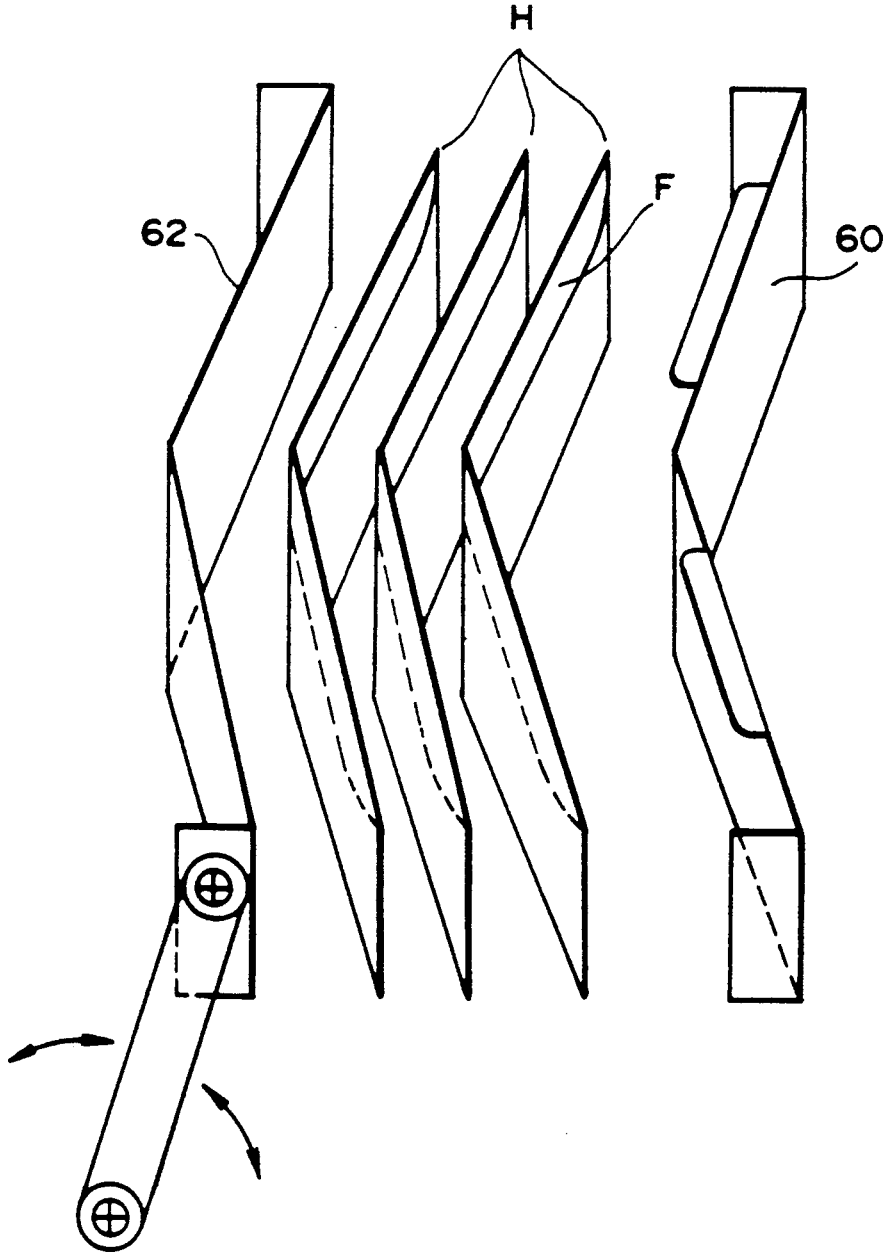

Thus sealed envelope H is sent guided by rollers 47, 48 and 49 to stacking portion 5 and inserted between pressing plate 62 connected to arm 64 and discharge plate 60 with its attitude upright. In the stacking portion, envelope H is kept being pressed against discharge plate 60 by a light pressing force. A successively coming sealed envelope is inserted between discharge plate 60 and the envelope previously stacked, or sequentially inserted between pressing plate 62 and discharge plate 60. In this case, since discharge plate 60 and pressing plate 62 are formed with a bend at their respective center with respect to horizontal plane (see, e.g., FIG. 9), it is possible, with this structure, that a sequentially inserted envelope is prevented from rubbing the center of the flap of the previous envelope with its front edge being pushed up and scraping or damaging the undried flap. Repeatedly, the sealing of the envelope just sealed is being undried, and therefore weak in strength. For this reason, when an envelope is pushed out upward sliding between the previously inserted envelope in the stacking portion and paper discharge plate 60, the flap is liable to be scraped or deformed otherwise on the way. To deal with this, in this embodiment, the envelope is inserted with its center being bent, thus providing the envelope with stiffness. For this reason, when a sealed envelope is inserted between the previous envelope and paper discharge plate 60 against the pressing force of pressing plate 62, the envelope can be prevented from bending or deforming. This inconvenience can be avoided because the envelopes on stack plate 61 are bent at their centers. As stated, the sealing operation and stacking operation can be smoothly carried out.

According to this embodiment, since the moving path of an envelope is turned over using a reverse roller, it is possible to arrange composing members in three-dimensional space. In addition, since the moving direction of an envelope is taken perpendicular to the fold of the flap, the moving length of envelope can be shortened. With these reason, the apparatus can be readily reduced in size.

Since the apparatus is divided into three components, and cases 2 and 3 are designed to be rotatable on shafts 4 and 5 respectively, jammed letter L or envelope H, if it occurs, can be easily taken out.

Moreover, since the opening of the envelope is spread out while envelope H is located at the stand-by position being halted by stopper 30, it is possible to expand the opening widely and stably, as a result, a letter can be easily inserted.

What is claimed is:

1. An enclosing and sealing apparatus comprising:

a hopper portion in which a plurality of envelopes each of which has a flap and a gummed portion thereon, are held;

a content-inserting portion in which a content is inserted into said envelope;

a guide means for guiding said envelope moving from said hopper portion to said content-inserting portion along an envelope-moving path;

a reverse roller disposed in said envelope-moving path for turning over said envelope-moving path;

a flap unfolding member disposed in the course of said moving path for unfolding the flap of said envelope when said envelope passes therethrough;

an expanding means for advancing into the inside from the opening of said envelope staying at said content-inserting portion and expanding said opening;

a paper-folding means for folding a content and inserting said folded content into said envelope with its opening being spread out by said expanding member; and a sealing means for damping the gummed portion on the flap of said envelope and closing said flap;

said sealing means comprising a pocket for temporarily storing said envelopes, a conveyer roller for sending out said envelope from said inserting portion toward said pocket, a damping member for damping said gummed portion on the flap of said envelope being driven by said conveyor roller, a discharge roller for sending out said envelope from said pocket, and a sealing member for sealing said opening by folding said flap of said envelope being sent by said discharge roller.

2. An enclosing and sealing apparatus according to claim 1, further comprising a stacking means for collecting sealed envelopes sent from said sealing means with keeping their folds of flaps substantially horizontally, said stacking means comprising a holding member for holding envelopes upright, a supporting member for supporting upright envelopes, a pressing member for holding said envelopes together with said supporting member, a biasing means for biasing said pressing member toward said supporting member, wherein said supporting member and pressing member are respectively shaped forming a bent at their center viewed from top, and said envelopes are collected with their folds of flaps being bent

3. An enclosing and sealing apparatus according to claim 1, further comprising:

a first case for holding said content-inserting portion, said expanding means, and said sealing means;

a second case for holding said hopper portion, said flap unfolding member, and said reverse roller and said stacking means; and a third case for holding said paper-folding means;

wherein said second and third cases are connected to said first case and are rotatable relative to said first case.

4. An enclosing and sealing apparatus comprising:

an inserting means for inserting a content into an envelope having a flap previously provided with a gummed portion;

a sealing means for damping the gummed portion on the flap of said envelope and closing said flap; and a stacking means for collecting sealed envelopes sent from said sealing means with keeping their folds of flaps substantially horizontally, said stacking means comprising a holding member for holding envelopes upright, a supporting member for supporting upright envelopes, a pressing member for holding said envelopes together with said supporting member, a biasing means for biasing said pressing member toward said supporting member, wherein said supporting member and pressing member are respectively shaped forming a bent at their center viewed from top, and said envelopes are collected with their folds of flaps being bent.

* * * * *